US007639200B2

(12) United States Patent
Yang et al.

(10) Patent No.: US 7,639,200 B2
(45) Date of Patent: Dec. 29, 2009

(54) ANTENNA

(75) Inventors: Chih-Yuan Yang, Taipei Hsien (TW); Po-Wei Kuo, Taipei Hsien (TW); Suo-Bing Su, Taipei Hsien (TW); Hung-Chang Ko, Taipei Hsien (TW); Wen-Chun Chen, Taipei Hsien (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 34 days.

(21) Appl. No.: 11/967,002

(22) Filed: Dec. 29, 2007

(65) Prior Publication Data

US 2009/0027293 A1 Jan. 29, 2009

(30) Foreign Application Priority Data

Jul. 23, 2007 (CN) ..... 2007 1 0201158

(51) Int. Cl.
*H01Q 1/50* (2006.01)

(52) U.S. Cl. ..... 343/860; 343/702; 343/895

(58) Field of Classification Search ..... 343/860, 343/853, 702, 846, 895
See application file for complete search history.

(56) References Cited

U.S. PATENT DOCUMENTS

| | | | |
|---|---|---|---|
| 5,892,490 | A | 4/1999 | Asakura |
| 6,674,405 | B2 | 1/2004 | Wang |
| 6,906,677 | B2 * | 6/2005 | Yamamoto et al. ..... 343/789 |

* cited by examiner

*Primary Examiner*—Hoang V Nguyen
(74) *Attorney, Agent, or Firm*—Frank R. Niranjan

(57) ABSTRACT

An antenna includes a ground plane, a match portion, and a radiation portion. The ground plane is used for grounding. The match portion is parallel to the ground plane, and is connected to the ground plane. The radiation portion is connected to one end of the match portion, and extends upwardly with respect to the ground plane. The radiation portion can be a spiral element or a meandrous element. The radiation portion can also include a main body extending upwardly with respect to the ground plane, and a plurality of branches extending parallelly along a same direction from the main body.

13 Claims, 12 Drawing Sheets

ANTENNA

BACKGROUND

1. Field of the Invention

The present invention generally relates to an antenna.

2. Description of Related Art

In recent years, as continuous demand for wireless devices for mobile communication remains, various communication systems have been developed, and high performance, small, light-weight wireless devices that comply to a plurality of communication systems using a single integrated unit are in demand as well. Accordingly, there is an inevitable demand for development of antennas equipped in these wireless devices.

As a result, Planar Inverted-F Antennas (PIFAs) and Reverse-Fed Planar Inverted-F Antennas (RFPIFAs) have been designed. Referring to FIG. 10, a PIFA antenna 10 includes a ground plane 11, a match portion 13, a radiation portion 15, a feeder line 17, and a stub 19. The ground plane 11 defines a feed hole 111 therein. The match portion 13 and the radiation portion 15 are parallel to the ground plane 11. One end of the feeder line 17 is connected to a feed point 131 between the match portion 13 and the radiation portion 15, while another end of the feeder line 17 passes through the feed hole 111. One end of the stub 19 is connected to a shorted end 133 of the match portion 13, while another end of the stub 19 is connected to the ground plane 11.

The radiation portion 15, the feeder line 17, the feed point 131, and the ground plane 111 form a capacitor area of the PIFA antenna 10. The match portion 13, the feeder line 17, the feed point 131 and the stub 19 form an inductor area of the PIFA antenna 10. Also referring to FIG. 11, an equivalent circuit of the PIFA antenna 10 is shown. A first terminal 180 is equivalent to the feed point 131, while a second terminal 190 is equivalent to the ground plane 11 A capacitor C is equivalent to the capacitor area of the PIFA antenna 10, while an inductor L is equivalent to the inductor area of the PIFA antenna 10. Therefore, the antenna 10 is equivalent to an LC circuit. Furthermore, referring to FIG. 12, an RFPIFA antenna 10' is also illustrated. In comparison with the PIFA antenna 10, a shorted end 133' is connected between the match portion 15' and one end of a match portion 13', while a feed point 131' is connected to another end of the match portion 13'.

However, the ground planes used in the PIFA antenna 10 and the RFPIFA antenna 10' determine main sizes of the antennas, and it is necessary to minimize the ground planes.

Therefore, improvements for an antenna are needed in the industry to address the aforementioned deficiency.

SUMMARY

An antenna includes a ground plane, a match portion, and a radiation portion. The ground plane is used for grounding. The match portion is parallel to the ground plane, and is connected to the ground plane. The radiation portion is connected to one end of the match portion, and extends upwardly with respect to the ground plane. The radiation portion can be a spiral element or a meandrous element. The radiation portion can also include a main body extending upwardly with respect to the ground plane, and a plurality of branches extending parallel to each other along a same direction from the main body.

Other advantages and novel features of the present invention will become more apparent from the following detailed description of preferred embodiment when taken in conjunction with the accompanying drawings.

DETAILED DESCRIPTION OF THE EMBODIMENTS

Reference will now be made to the drawings to describe preferred embodiments of the present antenna.

Certain terminology is used herein for the convenience of the reader only and is not to be taken as a limitation on the scope of the disclosure. For example, words such as "upward, ""downward," "horizontal," "vertical," and the like merely describe the configuration shown in the FIGS. The element or elements of any embodiment of the present disclosure may be oriented in any direction, and the terminology, therefore, should be understood as encompassing such variations unless otherwise specified.

Figure 1:
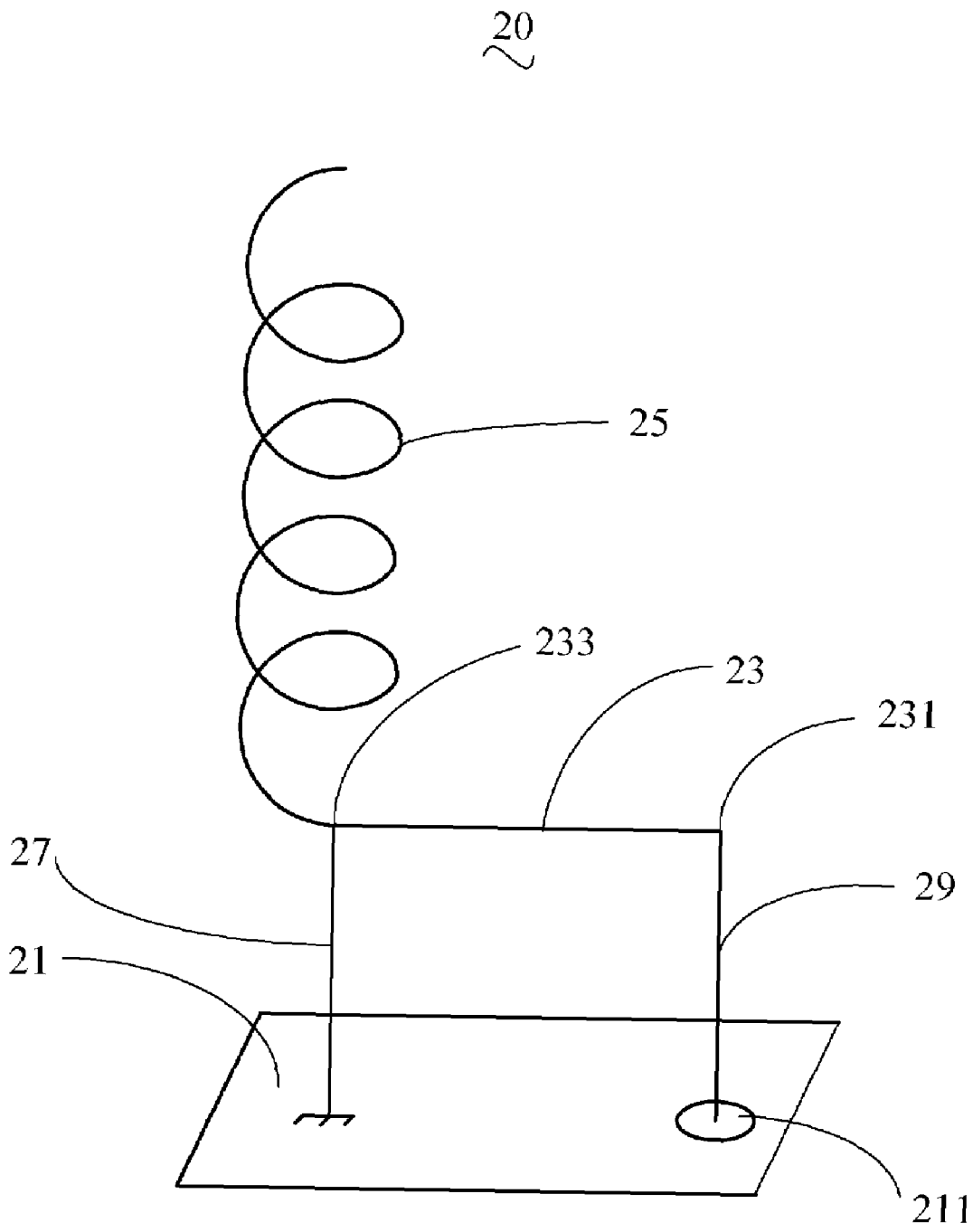
FIG. 1 is a schematic diagram showing an antenna in accordance with a first exemplary embodiment.

Referring to FIG. 1, an antenna 20 in accordance with a first embodiment includes a ground plane 21, a match portion 23, a radiation portion 25, a stub 27, and a feeder line 29. The ground plane 21 defines a feed hole 211. The match portion 23 is parallel to the ground plane 21. A feed point 231 and a junction 233 are formed on two ends of the match portion 23. The radiation portion 25 is connected to the shorted end 233 and extends upwards in a predetermined spiral manner. The stub 27 is connected to the ground plane 21 and the shorted end 233. The feeder line 29 passes through the feed hole 211, and is connected to the feed point 231.

Figure 2:
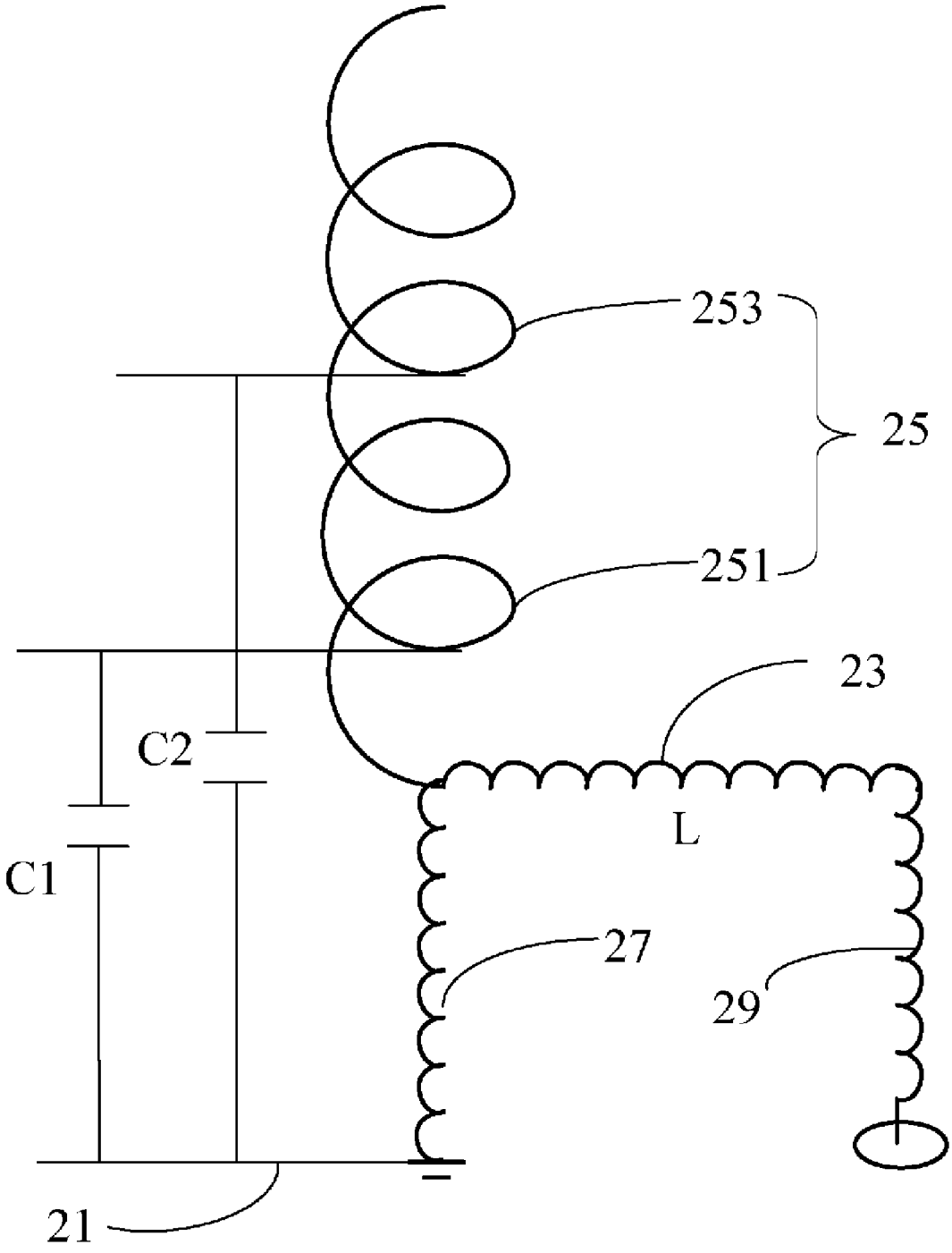
FIG. 2 is a simulation diagram showing the antenna of FIG. 1.

The radiation portion 25, the stub 27, and the ground plane 21 form a capacitor area of the PIFA antenna 20. The match portion 23, the stub 27, and the feeder line 29 form an inductor area of the PIFA antenna 20. Also referring to FIG. 2, a simulation diagram of the antenna 20 is illustrated. Each loop of the radiation portion 25 and the ground plane 21 form a capacitor. For example, a loop 251 and the ground plane 21 form a capacitor C1, and a loop 253 and the ground plane 21 form a capacitor C2. The match portion 23, the stub 27, and the feeder line 29 are considered as an inductor L. Therefore, an LC circuit is constructed by the capacitors, such as C1, C2, and the inductor L.

As mentioned above, the spiral radiation portion 25 extends upwards along a direction perpendicular to the ground plane 21, and its capacitor area is constructed by each loop of the radiation portion 25. Therefore, a diameter of each loop of the radiation portion 25, and not a length of the radiation portion 25, determines a size of the ground plane. Commonly, the diameter of each loop is smaller than the length of the radiation portion 25 thus, the size of the ground plane 21 can be minimized.

Figure 3:
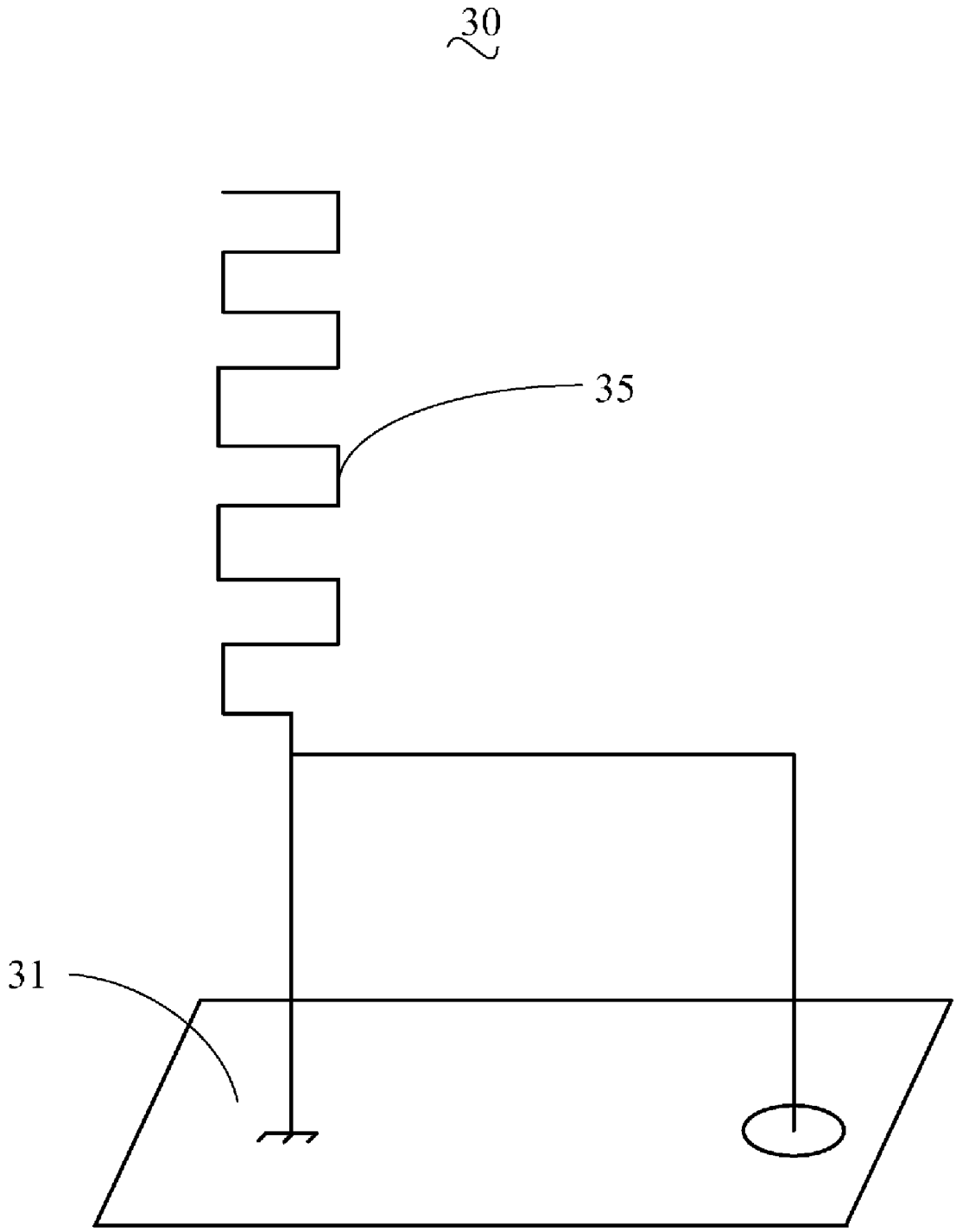
FIG. 3 is a schematic diagram showing an antenna in accordance with a second exemplary embodiment.
Figure 4:
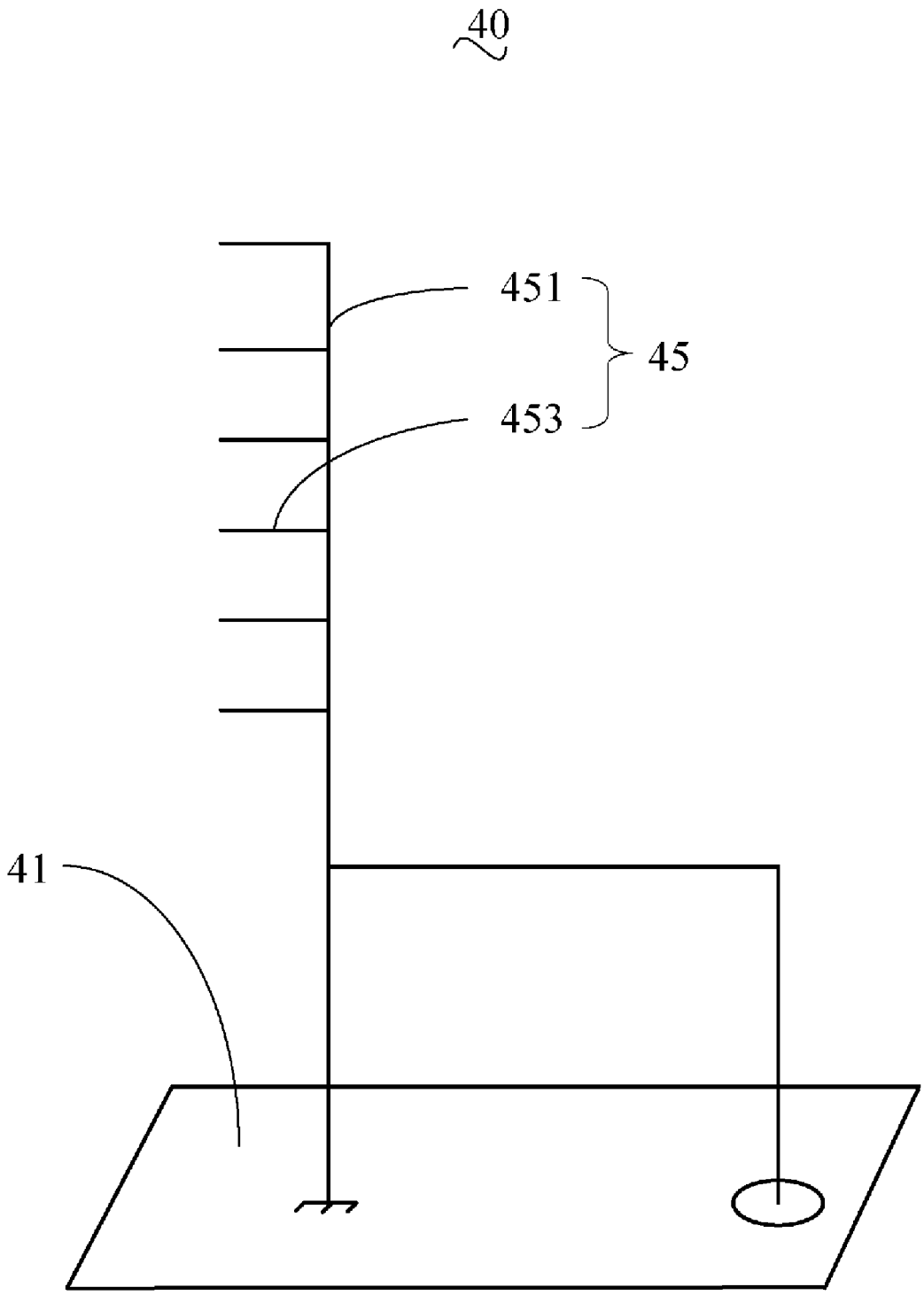
FIG. 4 is a schematic diagram showing an antenna in accordance with a third exemplary embodiment.

In a second embodiment, referring to FIG. 3, an antenna 30 includes a radiation portion 35 having similar function with the radiation portion 25 of FIG. 4. The radiation portion 35 is a meandrous element. The meandrous element and a ground plane 31 form a capacitor area thereof.

In a third embodiment, referring to FIG. 4, an antenna 40 includes a radiation portion 45 having similar functions as the radiation portion 25 of FIG. 1. The radiation portion 45 includes a main body 451 and a plurality of branches 453. The main body 451 extends upwardly with respect to a ground plane 41. The branches 453 extend parallel to each other along a same direction from the main body 451. The branches 453 and the ground plane 41 form a capacitor area of the antenna 40.

Figure 5:
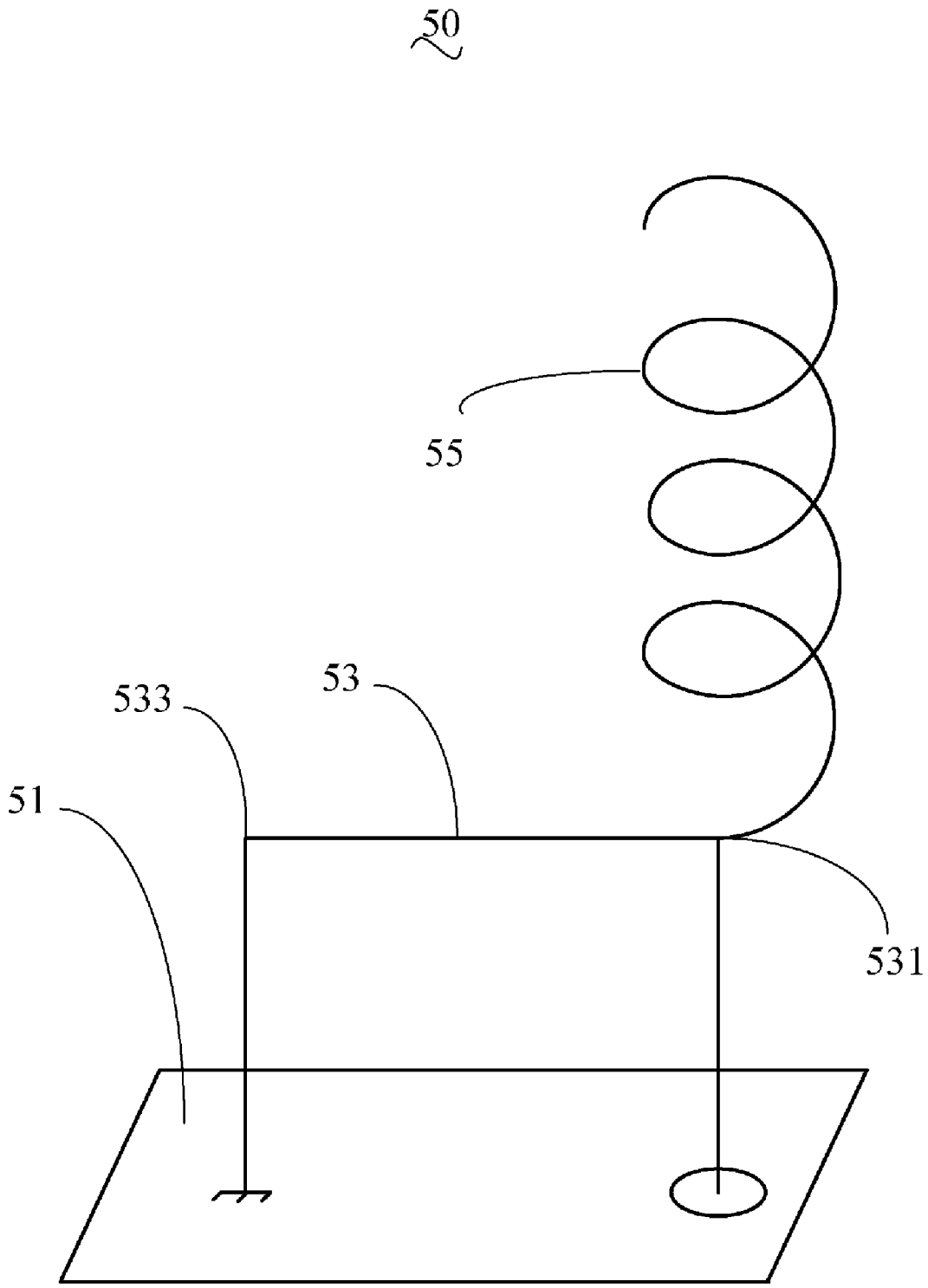
FIG. 5 is a schematic diagram showing an antenna in accordance with a fourth exemplary embodiment.

In a fourth embodiment, referring to FIG. 5, an antenna 50 includes a ground plane 51 a match portion 53 including a feed point 531 and a shorted end 533, and a radiation portion 55. In comparison with the antenna 40 of FIG. 4, the radiation portion 55 is not connected to the shorted end 533, but is connected the feed point 531 instead.

Figure 6:
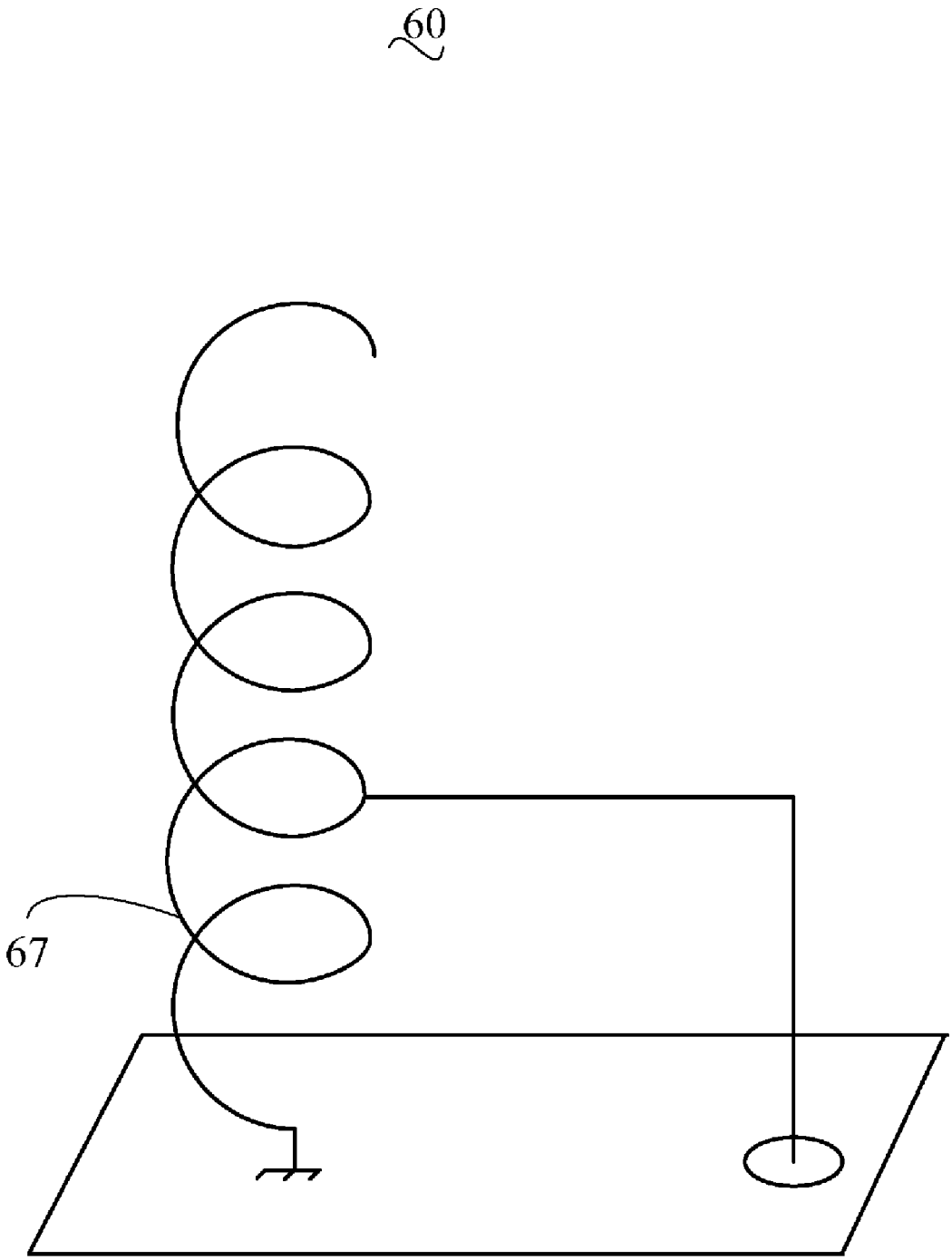
FIG. 6 is a schematic diagram showing an antenna in accordance with a fifth exemplary embodiment.
Figure 7:
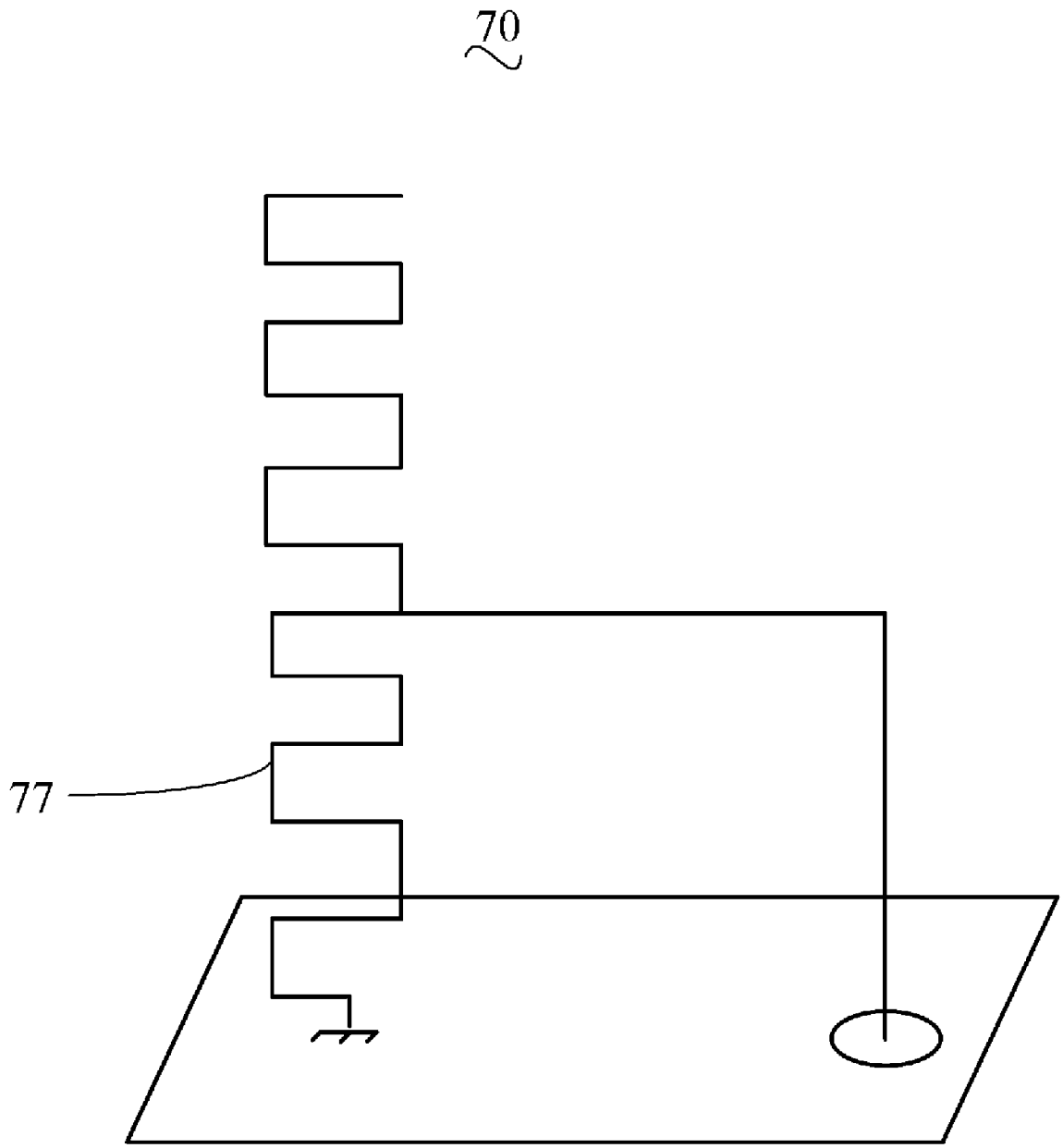
FIG. 7 is a schematic diagram showing an antenna in accordance with a sixth exemplary embodiment.

Furthermore, referring to FIG. 6, an antenna 60 in accordance with a fifth embodiment includes a spiral element 67 that consists of a radiation portion and a stub. Also referring to FIG. 7, an antenna 70 in accordance with a sixth embodiment includes a meandrous element 77 that consists of a radiation portion and a stub.

Figure 8:
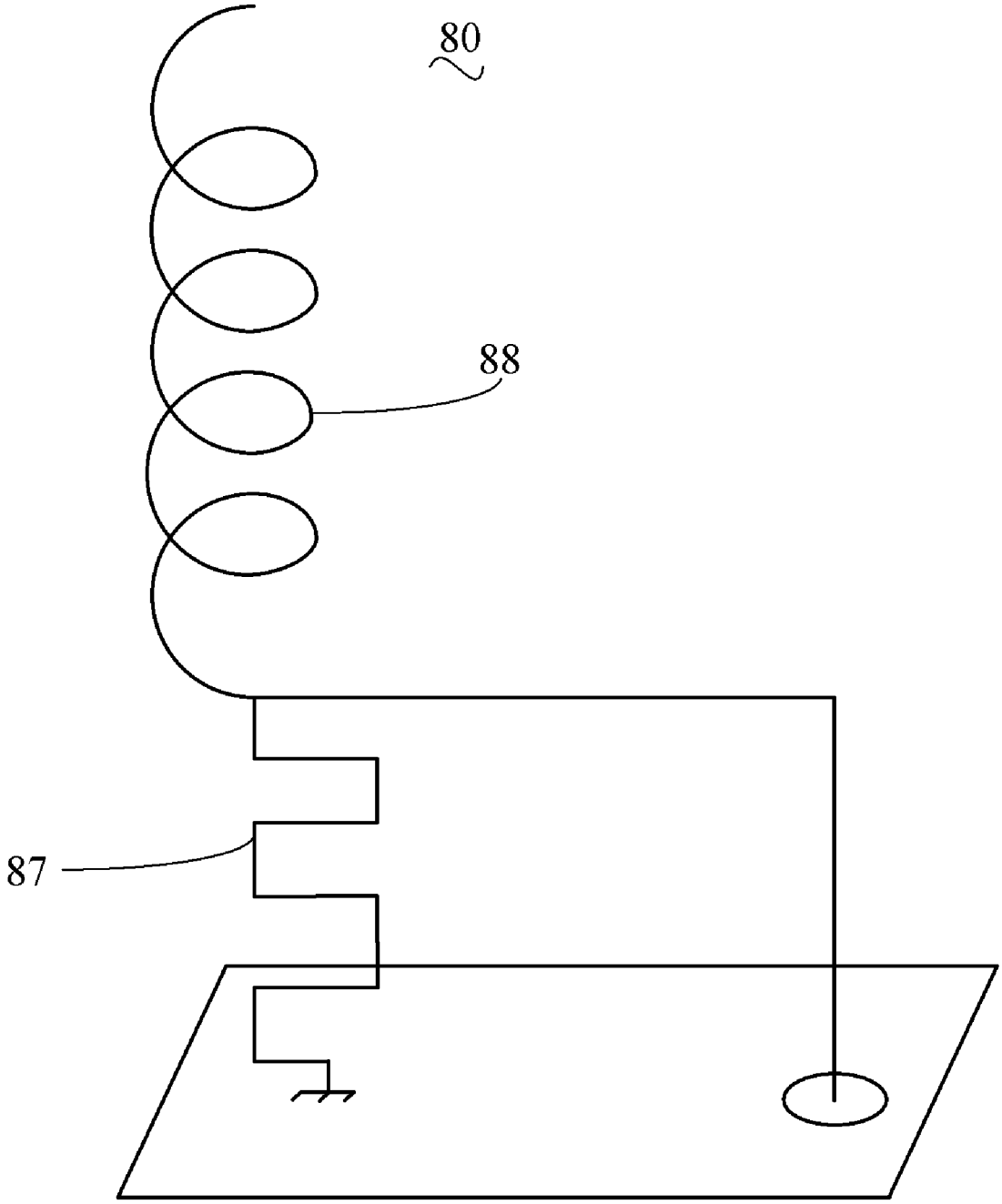
FIG. 8 is a schematic diagram showing an antenna in accordance with a seventh exemplary embodiment.
Figure 9:
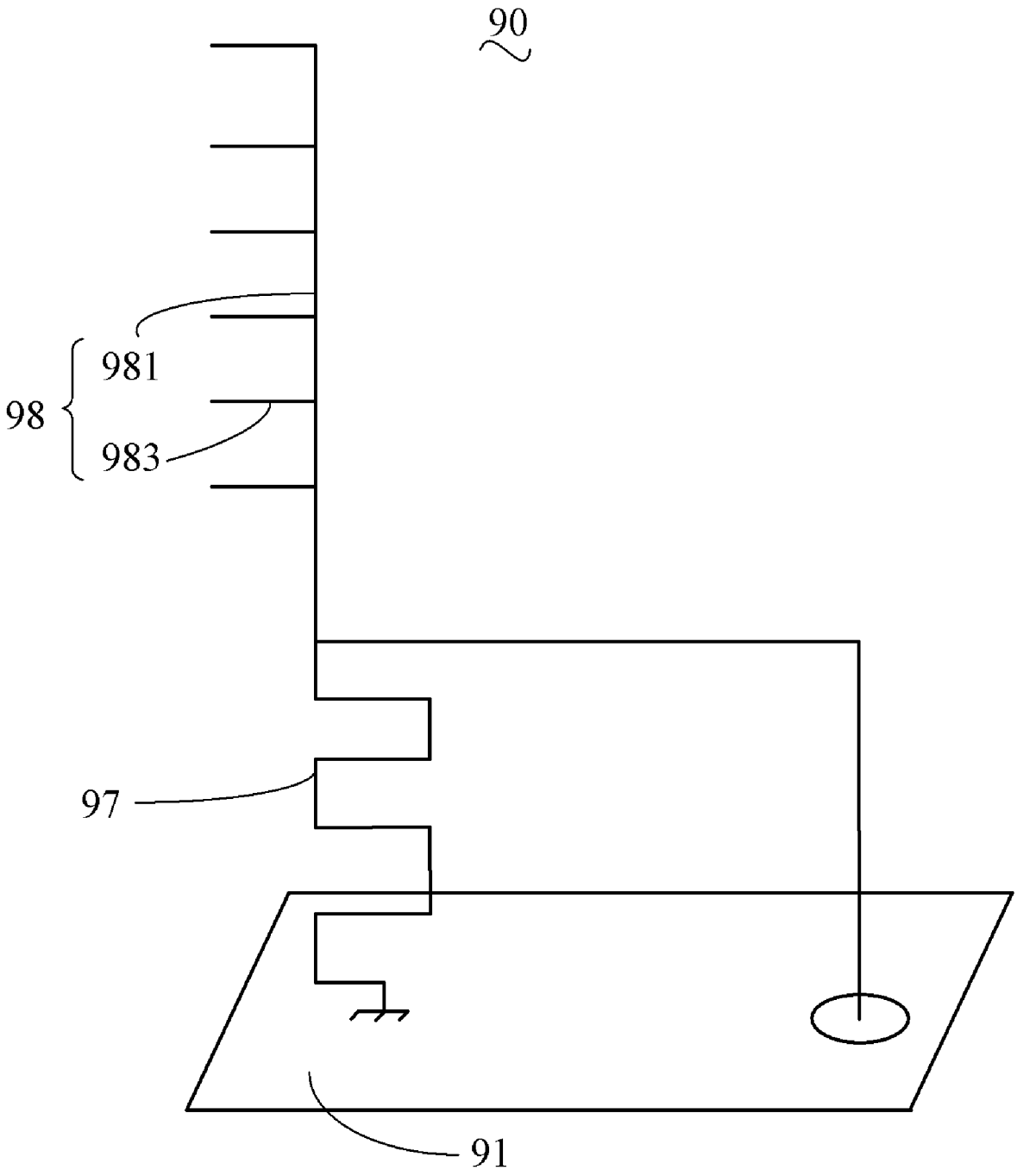
FIG. 9 is a schematic diagram showing an antenna in accordance with an eighth exemplary embodiment.
Figure 10:
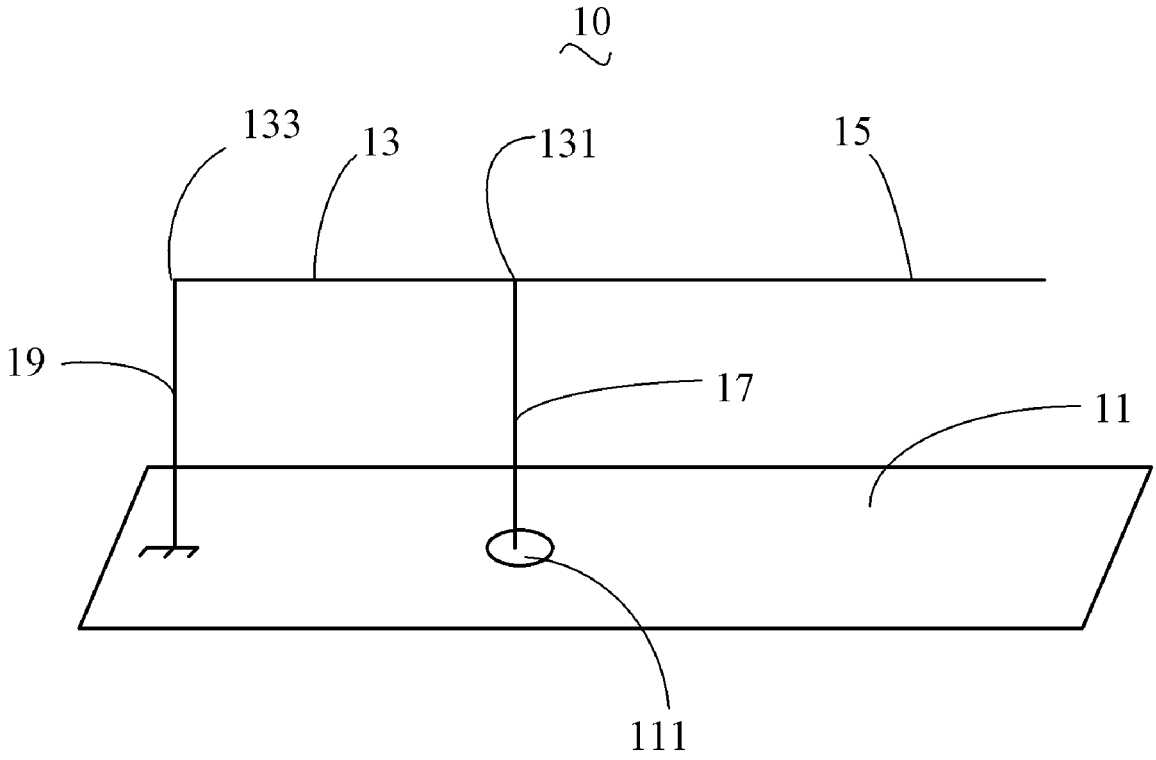
FIG. 10 (RELATED ART)
FIG. 10 is a schematic diagram showing a conventional PIFA antenna.
Figure 11:
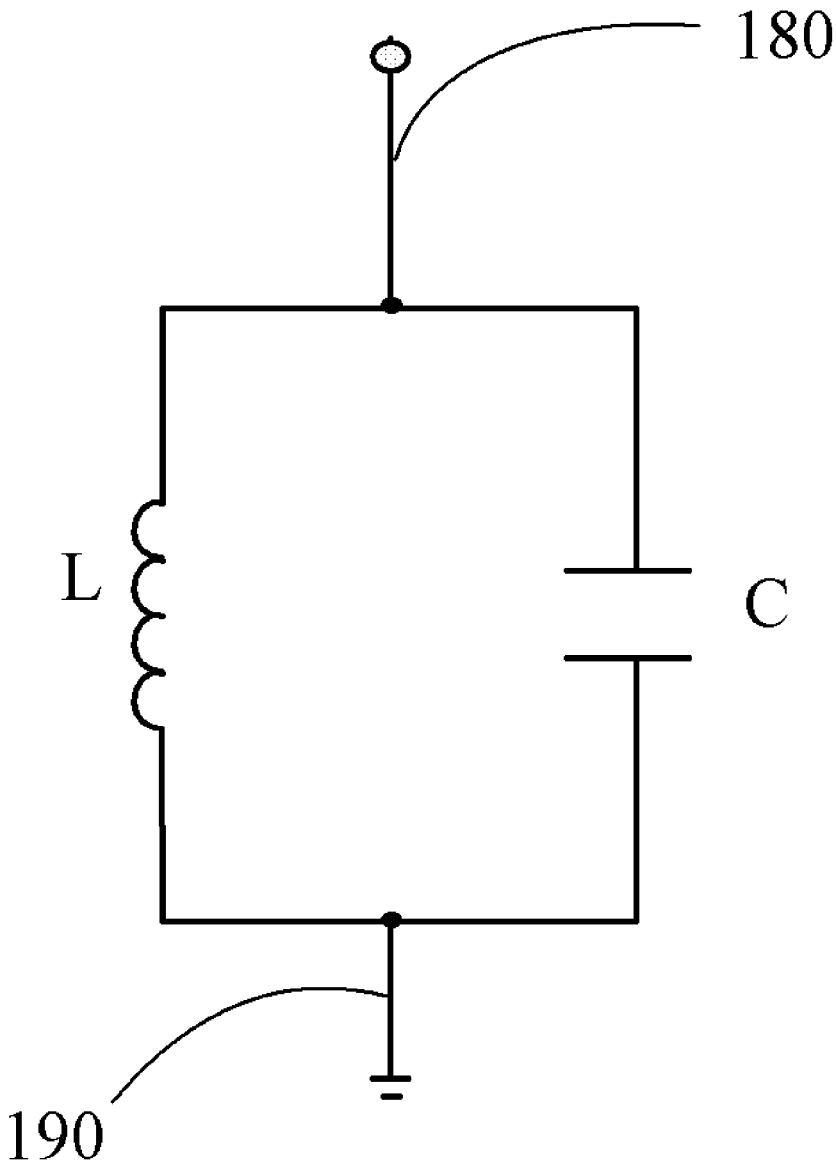
FIG. 11 (RELATED ART)
FIG. 11 is a schematic diagram showing an equivalent circuit of the PIFA antenna of FIG. 10.
Figure 12:
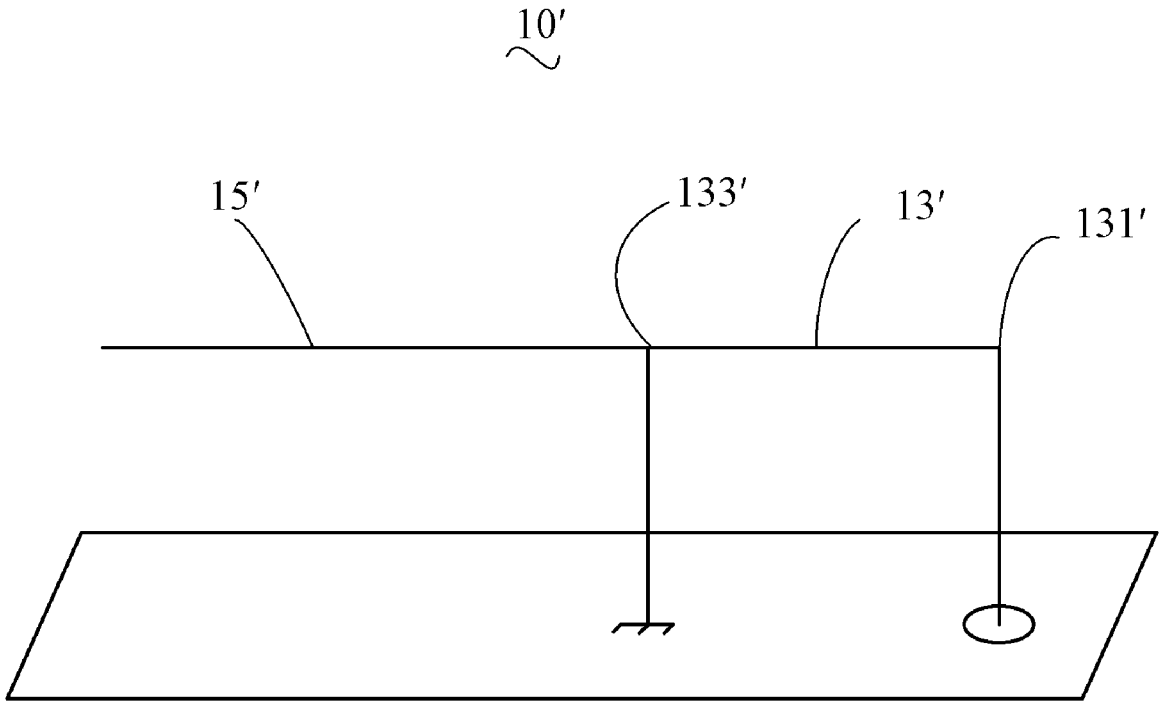
FIG. 12 (RELATED ART)
FIG. 12 is a schematic diagram showing a conventional RFPIFA antenna.

Moreover, referring to FIG. 8, an antenna 80 in accordance with a seventh embodiment includes a stub 87 and a radiation portion 88. The stub 87 has a meandrous shape. The radiation portion 88 has a spiral shape. Also referring to FIG. 9, an antenna 90 in accordance with an eighth embodiment includes a stub 97 and a radiation portion 98. The stub 97 has a meandrous shape. The radiation portion 98 includes a main body 981 and a plurality of branches 983. The main body 981 extends upwardly with respect to a ground plane 91. The branches 983 extend parallel to each other along a same direction from the main body 981.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An antenna, comprising:

a ground plane;

a match portion parallel to the ground plane, and connected to the ground plane;

a radiation portion connected to one end of the match portion, and extending upwardly with respect to the ground plane; and a stub connected to the match portion and the ground plane, wherein the stub is a spiral element.

2. The antenna according to claim 1, wherein the match portion comprises a shorted end connected to the stub.

3. The antenna according to claim 1, wherein the ground plane defines a feed hole therein.

4. The antenna according to claim 3, further comprising a feeder line passing through the feed hole.

5. The antenna according to claim 4, wherein the match portion comprises a feed point connected to the feeder line.

6. The antenna according to claim 1, wherein the radiation portion is a spiral element.

7. The antenna according to claim 1, wherein the radiation portion is a meandrous element.

8. The antenna according to claim 1, wherein the radiation portion comprises a main body extending upwardly with respect to the ground plane, and a plurality of branches extending parallel to each other along a same direction from the main body.

9. An antenna, comprising:

a ground plane;

a match portion combined with the ground plane to form an inductor area, the match portion extending along a first direction that is parallel to the ground plane; and a radiation portion combined with the ground plane to form a capacitor area, the radiation portion comprising a main body and a plurality of branches, the main body extending along a second direction that is perpendicular to the ground plane, and the branches extending along the first direction.

10. An antenna, comprising:

a ground plane;

a match portion connected to the ground plane;

a radiation portion connected to the match portion, and extending substantially perpendicularly with respect to the ground plane; and a stub connected to the match portion and the ground plane, the stub having a meandrous shape.

11. The antenna according to claim 10, wherein the radiation portion comprises a main body extending substantially perpendicularly with respect to the ground plane, and a plurality of branches extending along a same direction from the main body.

12. The antenna according to claim 10, wherein the radiation portion has a spiral shape.

13. The antenna according to claim 10, wherein the radiation portion has a meandrous shape.

* * * * *